US008696030B2

(12) United States Patent
Erisalu

(10) Patent No.: US 8,696,030 B2
(45) Date of Patent: Apr. 15, 2014

(54) OMNIVIEW CONTENTS DISPLAY SYSTEMS

(76) Inventor: Arnold Erisalu, Osoyoos (CA)

( * ) Notice: Subject to any disclaimer, the term of this patent is extended or adjusted under 35 U.S.C. 154(b) by 72 days.

(21) Appl. No.: 13/323,922

(22) Filed: Dec. 13, 2011

(65) Prior Publication Data

US 2012/0146322 A1 Jun. 14, 2012

Related U.S. Application Data

(60) Provisional application No. 61/422,944, filed on Dec. 14, 2010.

(51) Int. Cl.
*B42F 21/00* (2006.01)

(52) U.S. Cl.
USPC ..... 283/36; 283/37; 283/38; 283/39; 283/40; 283/42

(58) Field of Classification Search
USPC ..... 283/36–40, 42
See application file for complete search history.

(56) References Cited

U.S. PATENT DOCUMENTS

| | | | | |
|---|---|---|---|---|
| 154,768 | A * | 9/1874 | Sargent | 283/40 |
| 404,294 | A * | 5/1889 | Lester | 283/39 |
| 408,361 | A * | 8/1889 | Stephenson | 283/36 |
| 629,214 | A * | 7/1899 | Simpson | 283/40 |
| 1,132,222 | A * | 3/1915 | Smith | 283/40 |
| 2,288,066 | A * | 6/1942 | Bloom | 283/40 |
| 4,789,187 | A | 12/1988 | Corlew et al. | |
| 4,978,143 | A | 12/1990 | Ericson | |
| 5,761,485 | A | 6/1998 | Munyan | |
| 5,802,516 | A | 9/1998 | Shwarts et al. | |
| 6,244,628 | B1 | 6/2001 | Muller | |
| 6,896,294 | B2 | 5/2005 | Bidanset et al. | |

* cited by examiner

*Primary Examiner* — Kyle Grabowski
(74) *Attorney, Agent, or Firm* — RG Patent Consulting, LLC; Rachel Gilboy

(57) ABSTRACT

An omniview contents display system which is a quick, at-a-glance system for locating sections of any book or magazine, providing the chapter and range of pages, as well as having an indicator line that visually guides the user-reader's eye to a chapter bar. The chapter bar is a block style marking on the edge of the pages opposite the binding that designates the exact location of the chapter or section within the book. The exact location of a chapter can be easily located despite the book or type of printed and bound media being in a closed condition. The chapters, page ranges, and indicator lines may be printed on the covers as well as on the inside pages at the outside margins and allows the reader-user to quickly locate any section of the book from an open or closed book condition.

16 Claims, 5 Drawing Sheets

OMNIVIEW CONTENTS DISPLAY SYSTEMS

CROSS-REFERENCE TO RELATED APPLICATION

The present application is related to and claims priority from prior provisional application Ser. No. 61/422,944, filed Dec. 14, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of printed literature and more specifically relates to an omniview contents display system.

2. Description of the Related Art

In our modern society, printed media is used extensively for communicating information between human beings of a targeted social group, class, or demographic. Printed media uses ink to mark a sheet of paper with alphabetic characters, the sheet of paper referred to as a page. Larger works of printed and bound media are referred to as books, magazines, or periodicals or the like. A book is a set or collection of written, printed, or illustrated sheets of paper that is usually bound or fastened together to hinge at one side. Books may refer to works of literature or may be used for reference. One common practice for magazines or books is the inclusion of a table of contents, usually within the first few pages of the book, that briefly describe the various sections or chapters of the book and the page numbers that those sections can be found on. Traditionally authors provide a table of contents to help readers navigate a lengthy work. Since the practice of binding books became common, a table of contents bound within the book has been practiced, but it has not significantly changed since that time.

The first real revolution in locating particular sections of written communication has been in electronic media using a search function, but with printed media, it still remains archaically provided. The process of locating a section of interest can be time consuming, typically requiring the reader to flip back and forth between pages or closing the book and then turning to the first few pages to access the table of contents. Larger books may also print an index in some form in the back of the book to make it easier for the reader, but flipping through pages to locate the table of contents is still necessary which is undesirable.

Reference books are often used to look up information that is found in only one section or chapter of the book. A reader will thumb through the first few pages of a book to locate the table of contents in order to find the section that the desired information may be found on. The reader then turns to that section of pages to continue the search. In some examples, such as when using the Bible, a table of contents is very inefficient because the reader often has only a small window of time to locate the desired section. The most efficient manner of locating particular books or sections of the Bible still remains the lengthy and time consuming method of memorization. Students who study for upper education classes often spend a good deal of time just turning pages to find a chapter or section that is already known to be there, but just has to be found. The time is past due for an innovation that will revolutionize finding particular sections of printed media.

Various attempts have been made to solve the above-mentioned problems such as those found in U.S. Pat. Nos. 4,789,187; 4,978,143; 6,244,628; 6,896,294; 5,802,516; and 5,761,485. This art is representative of location indicators and marking systems for books. None of the above inventions and patents, taken either singly or in combination, is seen to describe the invention as claimed.

Ideally, a contents locating system should be easily seen and used and yet would be incorporated into a book or magazine cost effectively. Thus, a need exists for a reliable omniview contents display system to locate any section of a book at a glance and to avoid the above-mentioned problems.

BRIEF SUMMARY OF THE INVENTION

In view of the foregoing disadvantages inherent in the known printed literature art, the present invention provides a novel omniview contents display system. The general purpose of the present invention, which will be described subsequently in greater detail, is to provide at-a-glance locating of any chapter or section within a book despite the book being in a closed condition or open to a chapter different than the one now sought by the user.

The invention comprises a contents locating system for printed and bound media having at least one indicator line, a chapter bar, a chapter abbreviation indicia, and a page range listing indicia. The printed and bound media may comprise a front cover and a back cover. The table of contents is exteriorly displayed on a front cover, a back cover, or both front and back covers and in some embodiments may be displayed on the pages of the printed and bound media. An indicator line is located on a cover of the printed and bound media adjacent a perimeter edge of the cover and extends along a face of the cover and perpendicularly deviates (the chapter bars are directly in line with their respective indicia, perpendicularly deviating referring to the indicator lines going to the edge of the cover then down the edges of the pages, the cover being perpendicular to the edges of the pages) from the cover onto an outside edge of at least one page and terminating at a chapter bar. The present invention provides in alternate embodiments the possibility of presenting the chapter abbreviation indicia, with chapter bar, directly on the massed page edges of the (closed) book. In this case, the chapter bar (which are formed by printing indicia right to the page edge, before trimming) would show on the page edges (its thickness determined by the number of pages in that chapter) and the chapter abbreviation indicia may be printed on the massed page edge immediately to the left or the right of the relevant chapter bar. Chapter abbreviation indicia and page range listing indicia may be located on an interior contents page adjacent to the cover(s). Chapter abbreviation indicia, together with the page range indicia, may be located in the right and left margin(s) of the pages of the printed and bound media. Chapter abbreviation indicia and page range indicia for each specific chapter may be printed directly on the massed page edges of the book, together with a chapter bar.

The chapter bars are rectangular in appearance and are sized in height (if the book is sitting flat, breadth if book is located parallel to reader—chapter bars are substantially parallel to the binding, height corresponding to number of pages in the reference) accordingly with a corresponding number of pages within the chapter. The chapter abbreviation indicia and page range listing indicia may be spaced horizontally parallel to each other along a length of the front cover. The chapter abbreviation indicia and page range listing indicia may be spaced horizontally parallel to each other along a length of the back cover when greater than 40 sections are listed. The indicator lines run parallel with a top of a cover and the chapter abbreviation indicia is located on the perimeter edge of a cover of the printed and bound media and specifies a chapter.

Chapter abbreviation indicia and page range listing indicia are vertically displayed (along the edge of the book cover) with the chapter abbreviation indicia located above (above preferred but may be below or beside) page range listing(s) indicia. Chapter abbreviation indicia may comprise alphabetic characters or may comprise numeric characters in some printed and bound media. The chapter abbreviation indicia and page range listing indicia may be located on both sides of the same indicator line but in some embodiments may have the page range listing indicia on the same line with the section designations or the chapter abbreviation indicia. The page range listing indicia may be located adjacent chapter abbreviation indicia and specifies the range of page numbers that comprise the chapter.

At least one indicator line positioned parallel between the chapter abbreviation indicia and page range listing indicia connects the chapter bar located at the page edges opposite the book binding with chapter abbreviation indicia located on the outside margin of a cover. The indicator line visually leads a reader to the chapter bar which marks a number of pages within the chapter that are affiliated with the chapter abbreviation indicia and page range listing indicia. The contents locating system may be divided such that a partial list of chapter abbreviation indicia with page range listing indicia is located on a right margin of a front cover of printed and bound media and have a partial list or the remaining list of chapter abbreviation indicia and page range listing indicia located on the back cover. When more than 40 chapters or sections are listed, the listing may be divided between front and back covers. When listed on front and back covers, indicator line(s) may extend from the chapter abbreviation indicia and page range listing indicia on front cover to the corresponding chapter bar and from the chapter abbreviation indicia and page range listing indicia on the back cover to the corresponding chapter bars. In some embodiments, chapter bars may be visually aligned with the corresponding chapter abbreviation indicia and page range listing indicia but not have connecting indicator lines. Lines, bars and the like may be in various colors to assist in differentiating them one from another.

When chapter bars are printed onto the outside edge of at least one page, ink may (purposefully) transfer beyond the outside edge of the page such that when the outside edge is trimmed, the chapter bar is visible both on an open page and on outside edge of a printed and bound media when closed. The contents locating system is usable to easily identify and locate information contained within printed and bound media, despite the printed and bound media remaining in a closed condition. The contents locating system may also be printed on pages within the printed and bound media on a right or a left margin such that a reader-user can quickly locate a chapter or section without closing the cover.

The present invention holds significant improvements and serves as an omniview contents display system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, omniview contents display system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a printed media contents locating system and more particularly to an omniview contents display system as used to locate sections of printed media at a glance.

Generally speaking, the omniview contents display system is a quick, at-a-glance system for locating sections of any book or magazine providing the chapter and range of pages, as well as having an indicator line that visually guides the user-reader's eye to a chapter bar. The chapter bar comprises a block style marking on the edge of the pages designating the exact location of the chapter or section. The exact location of a chapter can be easily located despite the printed and bound media being in a closed condition. The chapters and page ranges may be printed on the covers as well as on the inside pages at the outside left or right margin.

Figure 1:
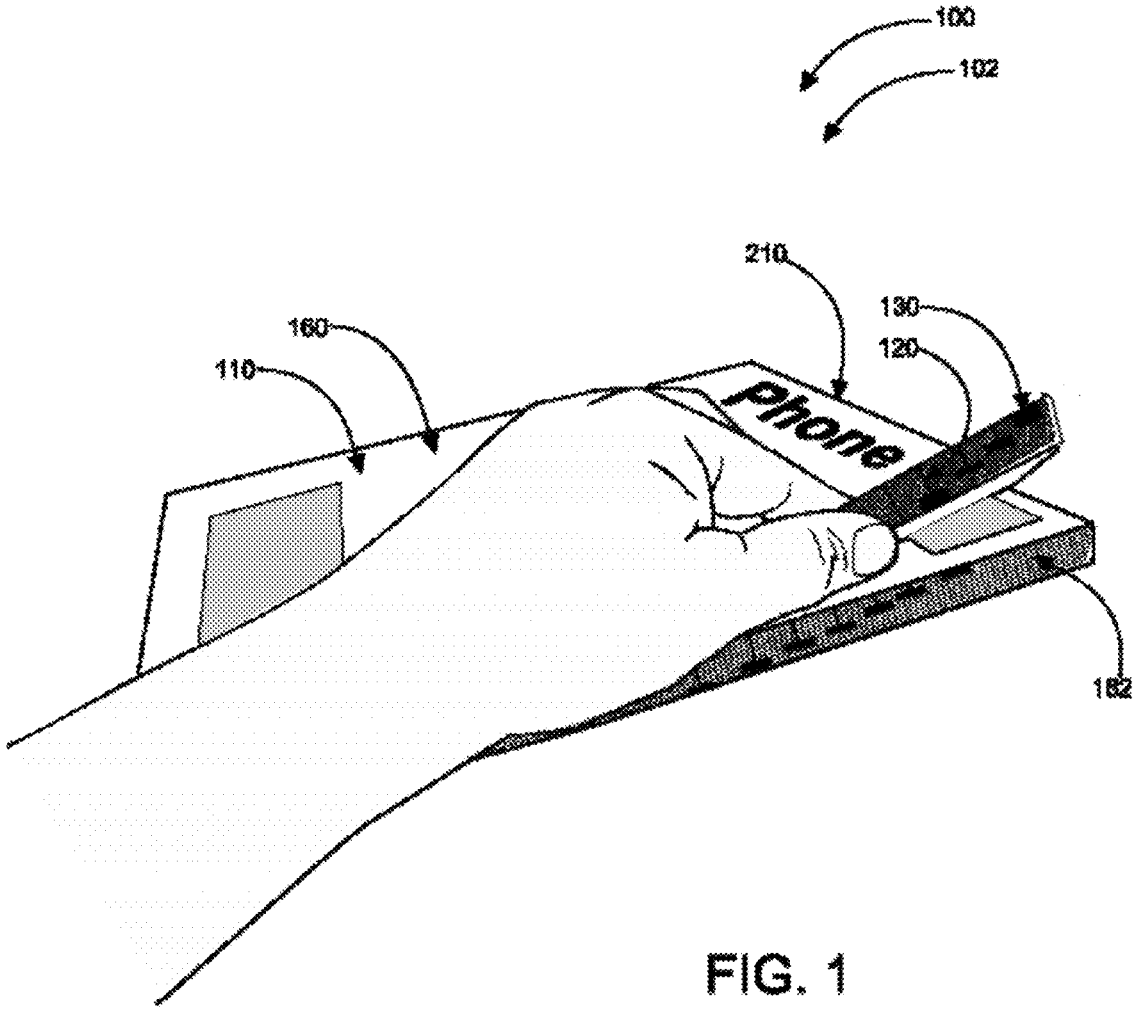
FIG. 1 shows a perspective view illustrating an in-use condition of an omniview contents display system according to an embodiment of the present invention.

Referring now to the drawings by numerals of reference there is shown now in FIG. 1, a perspective view illustrating an in-use condition of omniview contents display system 100 according to an embodiment of the present invention.

Contents locating system 102 for printed and bound media 110 may comprise at least one indicator line 120, chapter bar 130, chapter abbreviation indicia 140, and page range listing indicia 150. Printed and bound media 110 comprises front cover 160 and back cover 170. Chapter abbreviation indicia 140 and page range listing indicia 150 are preferably vertically displayed on cover 162 or a page and may have indicator line 120 located on cover 162 of printed and bound media 110 adjacent a perimeter edge 180 of cover 162 extending along a face of cover 162 and perpendicularly deviating from cover 162 onto an perimeter edge 180 of at least one page terminating at chapter bar 130.

Chapter abbreviation indicia 140 is preferably located on perimeter edge 180 of cover 162 of printed and bound media 110 and specifies a chapter location and page range listing indicia 150 which is located adjacent chapter abbreviation indicia 140 and specifies page numbers within a range. At least one indicator line 120 is positioned substantially parallel between chapter abbreviation indicia 140 and page range listing indicia 150 and at least one indicator line 120 connects chapter bar 130 with chapter abbreviation indicia 140 visually leading a reader to chapter bar 130. Chapter bar 130 marks a number of pages included as affiliated to chapter abbreviation indicia 140 and page range listing indicia 150; wherein contents locating system 102 is usable to identify and locate information contained within printed and bound media 110, despite printed and bound media 110 remaining in a closed condition. In this way the present invention serves to promote reading and locating efficiency.

Figure 2:
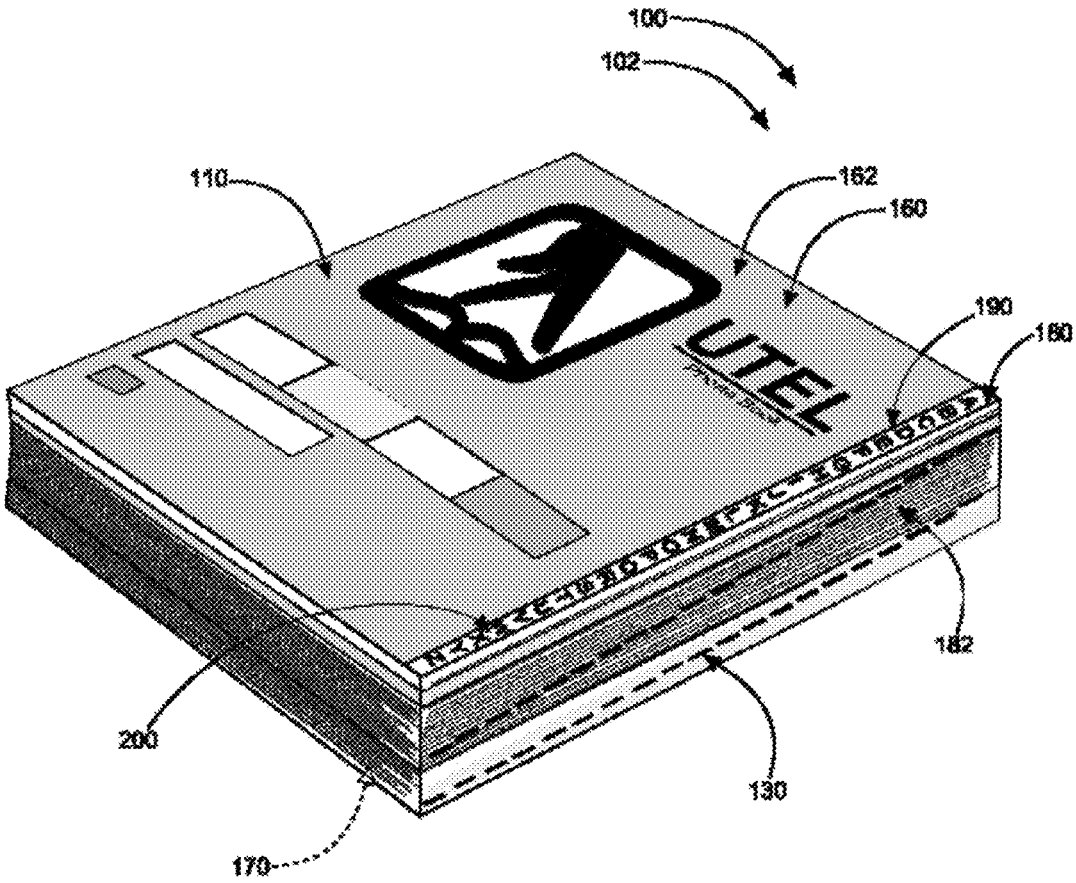
FIG. 2 is a perspective view illustrating an omniview contents display system for alphabetized sections according to an embodiment of the present invention of FIG. 1.

Referring now to FIG. 2, a perspective view illustrating omniview contents display system 100 for alphabetized sections according to an embodiment of the present invention of FIG. 1.

Chapter abbreviation indicia 140 may comprise alphabetically arranged characters with page range listing indicia 150 and may be spaced horizontally parallel to each other along a length of front cover 160. Contents locating system 102 is dividable such that a partial list of chapter abbreviation indicia 140 with page range listing indicia 150 is located on a right margin 190 of front cover 160 of printed and bound media 110 and partial list of chapter abbreviation indicia 140 with page range listing indicia 150 may be located on a left margin 199 of back cover 170 of printed and bound media 110. When a partial list of chapter abbreviation indicia 140 and page range listing indicia 150 are located on front cover 160, at least one indicator line 120 may extend from chapter abbreviation indicia 140 and page range listing indicia 150 on front cover 160 to at least one corresponding chapter bar 130. When a partial list of chapter abbreviation indicia 140 and page range listing indicia 150 are located on back cover 170, at least one indicator line 120 may extend from chapter abbreviation indicia 140 and page range listing indicia 150 on back cover 170 to at least one corresponding chapter bar 130.

Figure 3:
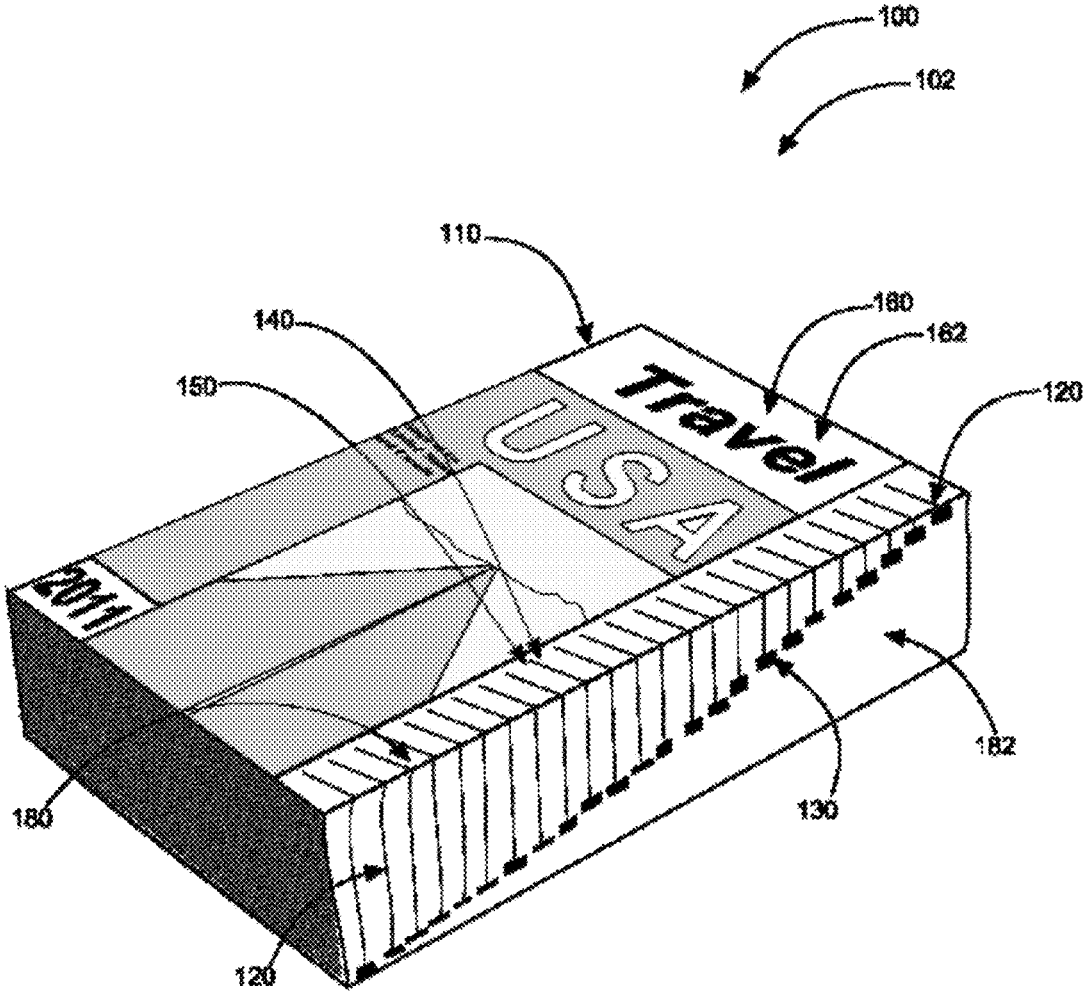
FIG. 3 is a perspective view illustrating a preferred omniview contents display system according to an embodiment of the present invention of FIG. 1.

Referring now to FIG. 3, a perspective view illustrating a preferred omniview contents display system 100 according to an embodiment of the present invention of FIG. 1.

Table of contents 200 is exteriorly displayed on cover(s) 162 of printed and bound media 110 and printed parallel with top of cover 210, parallel with indicator line 120, and positioned vertically along perimeter edge 180 of cover(s) 162 opposite printed and bound media 110 binding. Chapter abbreviation indicia 140 are preferably located above page range listing indicia 150 having chapter abbreviation indicia 140 and page range listing indicia 150 located on both sides of the same indicator line 120. Chapter bar(s) 130 are rectangular in preferred embodiments and may be sized in height accordingly with a corresponding number of pages of a chapter. Contents locating system 102 in alternate embodiments may comprise a retrofit kit having a stamp and ink system for use with (existing) books without omniview contents display system 100. When chapter bar(s) 130 is printed onto outside edge 182 of at least one page, ink preferably purposefully 'bleeds' beyond outside edge 182 such that when outside edge 182 is trimmed, chapter bar(s) 130 is visible on an open page and on outside edge 182. In this way the present invention also interiorly displays locating information.

Figure 4:
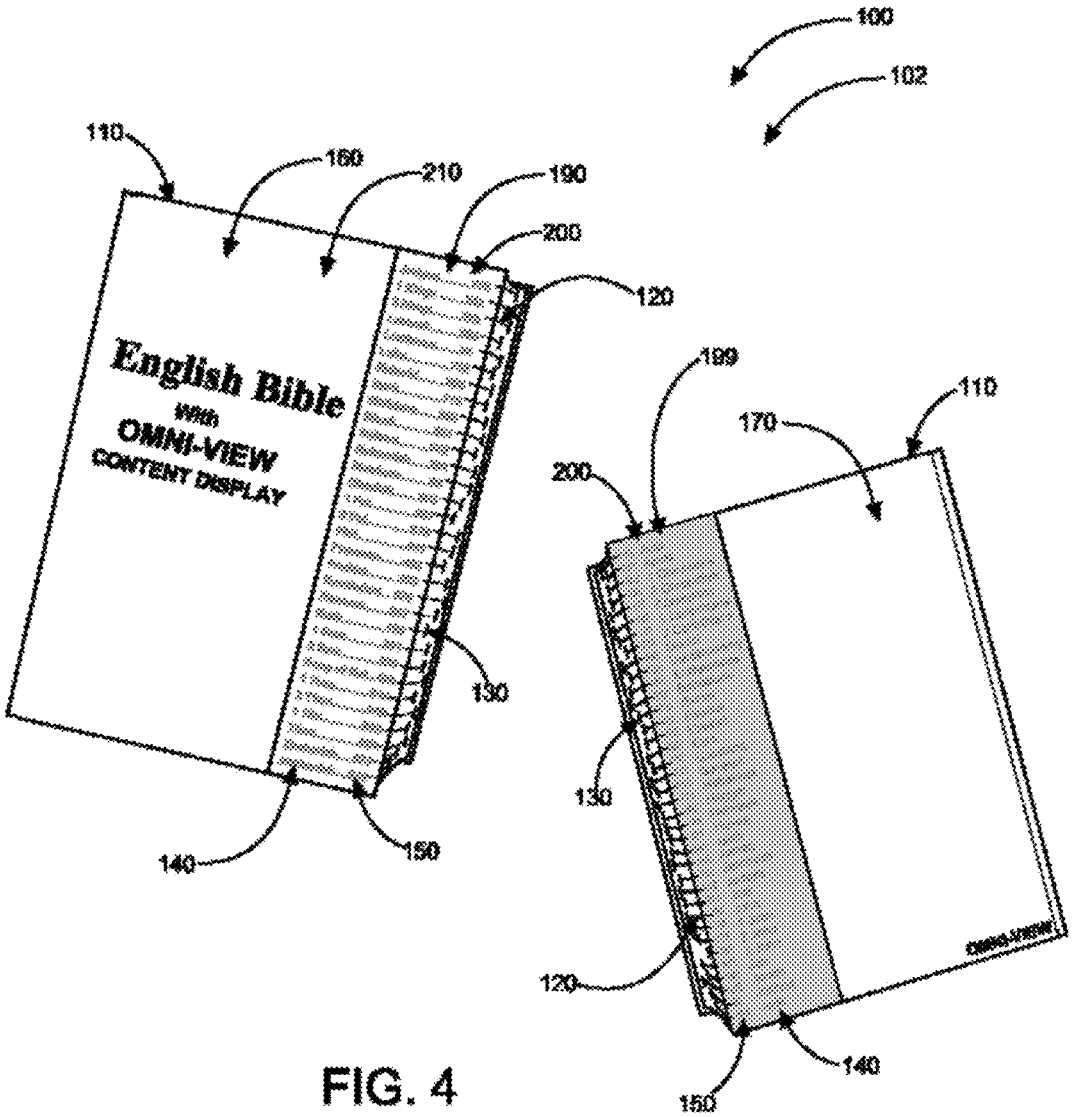
FIG. 4 is a perspective view illustrating an omniview contents display system as used for a Bible according to an embodiment of the present invention of FIG. 1.

Referring now to FIG. 4, a perspective view illustrating omniview contents display system 100 as used for a Bible according to an embodiment of the present invention of FIG. 1.

Chapter abbreviation indicia 140 and page range listing indicia 150 may be spaced horizontally parallel to each other along a length of back cover 164. Contents locating system 102 may be divided such that a partial list of chapter abbreviation indicia 140 with page range listing indicia 150 is located on right margin 190 of a front cover 160 of printed and bound media 110 and have a partial list or the remaining list of chapter abbreviation indicia 140 and page range listing indicia 150 located on back cover 164. When more than 40 chapters or sections are listed for example, the listing may be divided between front cover 160 and back cover 164 (depending on desired font size, number of chapters and the like.) When listed on front cover 160 and back cover 164, indicator line 120 may extend from chapter abbreviation indicia 140 and page range listing indicia 150 on front cover 160 to the corresponding chapter bar(s) 130 and from chapter abbreviation indicia 140 and page range listing indicia 150 on back cover 164 to the corresponding chapter bar(s) 130. In some embodiments, chapter bar(s) 130 may be visually aligned with the corresponding chapter abbreviation indicia 140 and page range listing indicia 150 but not have connecting indicator line 120.

Omniview contents display system 100 may be manufactured and provided for sale in on wide variety of book sizes and shapes for a wide assortment of applications and even as a kit. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized markings, different color combinations, stickers, marking means, stamp(s) and ink(s), parts may be sold separately, etc., may be sufficient.

Figure 5:
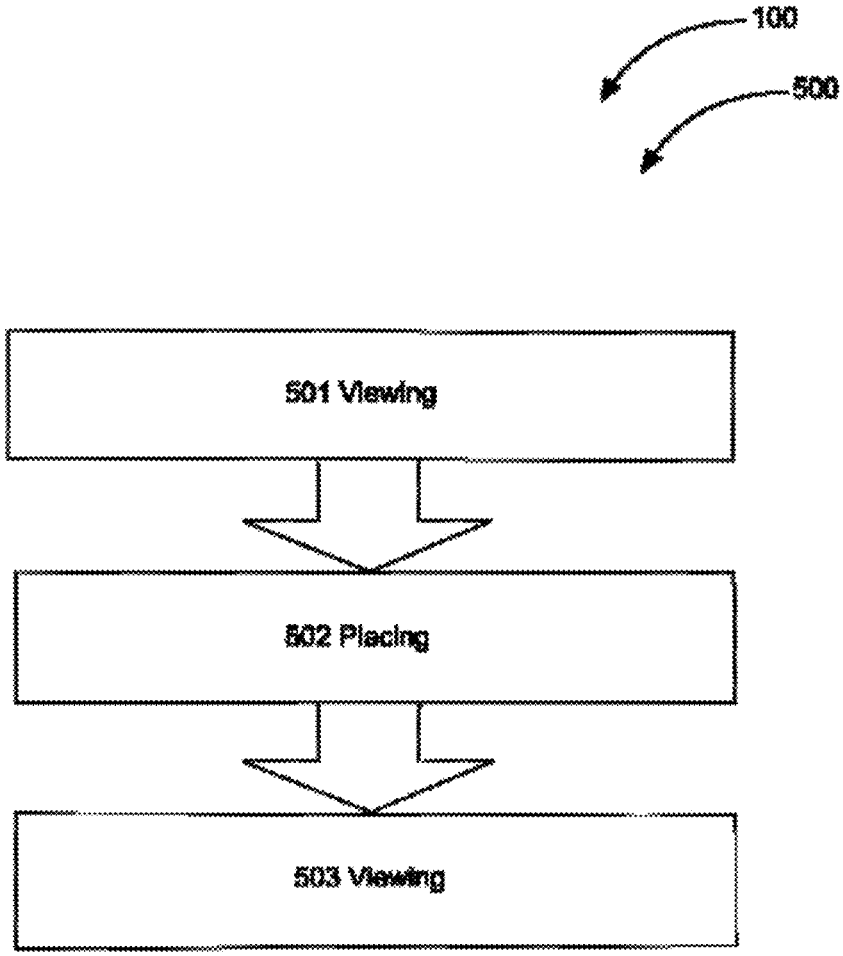
FIG. 5 is a flowchart illustrating a method of use for an omniview contents display system according to an embodiment of the present invention of FIGS. 1-4.

Referring now to FIG. 5, a flowchart illustrating method of use 500 for omniview contents display system 100 according to an embodiment of the present invention of FIGS. 1-4.

A method of using (method of use 500) contents locating system 102 for printed and bound media 110 preferably comprises the steps of: step one 501 viewing outside cover(s) 162 of printed and bound media 110 to identify a user-desired location to turn to; step two 502 placing a finger on a located chapter bar(s) 130 on a page(s) edge and opening printed and bound media 110 to that location; and step three 503 viewing printed and bound media 110.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A contents locating system for printed and bound media comprising:

a) a printed and bound medium comprising a cover and a page, each further comprising a surface and an edge;
b) at least one indicator line;
c) a chapter bar;
d) a chapter abbreviation indicia; and
e) a page range listing indicia;
f) wherein said indicator line is located on a surface of said printed and bound media medium adjacent a perimeter edge of said surface and extends along a face of said surface and perpendicularly deviates from said surface onto an outside edge of at least one page and terminates at said chapter bar;
g) wherein said chapter abbreviation indicia is located on said perimeter edge of said cover surface of said printed and bound medium and specifies a chapter;
h) wherein said page range listing indicia is located adjacent said chapter abbreviation indicia and specifies page numbers within a range;
i) wherein said at least one indicator line is positioned parallel between said chapter abbreviation indicia and said page range listing indicia and said at least one indicator line connects said chapter bar with said chapter abbreviation indicia;
j) wherein said chapter bars are sized in height accordingly with a corresponding number of said pages of said chapter;
k) wherein said indicator line visually leads a reader to said chapter bar, said chapter bar marking a number of said pages included as affiliated to said chapter abbreviation indicia and said page range listing indicia;
l) wherein said contents locating system is usable to identify and locate information contained within said printed and bound medium, despite said printed and bound medium remaining in a closed condition; and wherein said contents locating system is dividable such that a partial list of said chapter abbreviation indicia with said page range listing indicia is located on a right margin of said front surface of said printed and bound medium and a partial list of said chapter abbreviation indicia with said page range listing indicia is located on a left margin of said back surface of said printed and bound medium.

2. The contents locating system for printed and bound media of claim 1 wherein said indicator lines run parallel with a top of said surface.

3. The contents locating system for printed and bound media of claim 1 wherein said chapter abbreviation indicia, together with said page range indicia, are located in said margins of said surface of said printed and bound medium.

4. The contents locating system for printed and bound media of claim 1 wherein said at least one indicator line, said chapter bar, said chapter abbreviation indicia and said page range listing indicia are exteriorly displayed on a combination of at least one said surface and at least one said edge of said printed and bound medium.

5. The contents locating system for printed and bound media of claim 1 wherein said chapter abbreviation indicia and said page range listing indicia are located on an interior contents page adjacent to said surface.

6. The contents locating system for printed and bound media of claim 1 wherein said printed and bound medium comprises a front surface and a back surface.

7. The contents locating system for printed and bound media of claim 1 wherein when said partial list of said chapter abbreviation indicia and said page range listing indicia are located on said front surface, said at least one indicator lines extends from said chapter abbreviation indicia and said page range listing indicia on said front surface to at least one corresponding said chapter bar.

8. The contents locating system for printed and bound media of claim 7 wherein said chapter abbreviation indicia and said page range listing indicia are spaced horizontally parallel to each other along a length of said front surface.

9. The contents locating system for printed and bound media of claim 1 wherein said chapter abbreviation indicia comprise alphabetic characters.

10. The contents locating system for printed and bound media of claim 1 wherein said contents locating system comprises a kit further comprising a stamp and ink structured and arranged for retro-fitting said printed and bound medium.

11. The contents locating system for printed and bound media of claim 1 wherein said chapter abbreviation indicia and said page range listing indicia are vertically displayed.

12. The contents locating system for printed and bound media of claim 1 wherein said chapter abbreviation indicia and said page range listing indicia are spaced horizontally parallel to each other along a length of said back surface.

13. The contents locating system for printed and bound media of claim 1 wherein said chapter abbreviation indicia and page range indicia for each specific said chapter are printed directly on page edges of said printed and bound medium, together with said chapter bar.

14. The contents locating system for printed and bound media of claim 1 wherein when said chapter bar is structured and arranged onto said outside edge of at least one said page, such that said chapter bar is visible on an open said page and on said outside edge.

15. A contents locating system for printed and bound media comprising:

a) a printed and bound media medium comprising a cover and a page, each further comprising a surface and an edge;
b) at least one indicator line;
c) a chapter bar;
d) a chapter abbreviation indicia; and
e) a page range listing indicia;
f) wherein a table of contents is exteriorly displayed on a surface (s) of said printed and bound medium;
g) wherein said printed and bound medium comprises a front surface and a back surface;
h) wherein said indicator line is located on said surface of said printed and bound medium adjacent a perimeter edge of said surface and extends along a face of said surface and perpendicularly deviates from said surface onto an outside edge of at least one page and terminates at said chapter bar;

i) wherein said chapter bars are rectangular;

j) wherein said chapter bars are sized in height accordingly with a corresponding number of said pages of a chapter;

k) wherein said chapter abbreviation indicia and said page range listing indicia are spaced horizontally parallel to each other along a length of said front surface;

l) wherein said chapter abbreviation indicia and said page range listing indicia are spaced horizontally parallel to each other along a length of said back surface;

m) wherein said indicator lines run parallel with a top of said surface;

n) wherein said chapter abbreviation indicia is located on said perimeter edge of said surface of said printed and bound medium and specify said chapter;

o) wherein said chapter abbreviation indicia and said page range listing indicia are vertically displayed;

p) wherein said chapter abbreviation indicia are located above said page range listing(s) indicia;

q) wherein said chapter abbreviation indicia comprises alphabetic characters;

r) wherein said chapter abbreviation indicia and said page range listing indicia are located on both sides of same said indicator line;

s) wherein said page range listing indicia is located adjacent said chapter abbreviation indicia and specifies said page numbers within a range;

t) wherein said at least one indicator line is positioned parallel between said chapter abbreviation indicia and said page range listing indicia and said at least one indicator line connects said chapter bar with said chapter abbreviation indicia;

u) wherein said indicator line visually leads a reader to said chapter bar, said chapter bar marking a number of said pages included as affiliated to said chapter abbreviation indicia and said page range listing indicia;

v) wherein said contents locating system is divided such that a partial list of said chapter abbreviation indicia with said page range listing indicia is located on a right margin of said front surface of said printed and bound media;

w) wherein when said partial list of said chapter abbreviation indicia and said page range listing indicia are located on said front surface, said at least one indicator line(s) extends from said chapter abbreviation indicia and said page range listing indicia on said front surface to at least one corresponding said chapter bar;

x) wherein when said chapter bar is structured and arranged onto said outside edge of at least one said page, such that said chapter bar is visible both on an open said page and on said outside edge;

y) wherein said contents locating system is usable to identify and locate information contained within said printed and bound medium, despite said printed and bound medium remaining in a closed condition; and wherein said contents locating system is dividable such that a partial list of said chapter abbreviation indicia with said page range listing indicia is located on a right margin of said front surface of said printed and bound medium and a partial list of said chapter abbreviation indicia with said page range listing indicia is located on a left margin of said back surface of said printed and bound medium.

16. A method of using a contents locating system for printed and bound media comprising the steps of: providing the contents locating system for printed and bound media of claim 15;

a) viewing an outside surface of said printed and bound medium to identify a user-desired location to turn to;

b) placing a finger on a located chapter bar on a page edge and opening said printed and bound medium to that location; and c) viewing printed and bound medium.

* * * * *